United States Patent [19]

Geoffrey

[11] Patent Number: 5,010,690

[45] Date of Patent: Apr. 30, 1991

[54] ADJUSTABLE THRESHOLD ASSEMBLY WITH WATER-TIGHT SEALS

[75] Inventor: David C. Geoffrey, Richmond, Ind.

[73] Assignee: Imperial Products, Inc., Richmond, Ind.

[21] Appl. No.: 509,704

[22] Filed: Apr. 14, 1990

[51] Int. Cl.[5] ..... E06B 1/70

[52] U.S. Cl. ..... 49/468; 49/469

[58] Field of Search ..... 49/467–471, 49/417–419

[56] References Cited

U.S. PATENT DOCUMENTS

| | | | |
|---|---|---|---|
| 945,431 | 1/1910 | Willson | 49/419 |
| 2,818,614 | 1/1958 | Lapka | 49/469 |
| 3,273,287 | 9/1966 | Pease | 49/470 X |
| 3,346,994 | 8/1985 | Kesler . | |
| 3,762,100 | 10/1973 | Kempel . | |
| 3,900,967 | 8/1975 | Bursk et al. | 49/471 X |
| 3,962,828 | 6/1976 | McAllister | 49/468 |
| 3,967,412 | 7/1976 | Governale . | |
| 4,003,162 | 1/1977 | Britt | 49/469 X |
| 4,224,766 | 9/1980 | Procton | 49/469 X |
| 4,287,684 | 9/1981 | McKann | 49/469 X |
| 4,447,987 | 5/1984 | Lesosky | 49/469 X |
| 4,457,110 | 7/1984 | Beirnes | 49/419 |
| 4,565,033 | 1/1986 | Tinfow | 49/469 X |

*Primary Examiner*—Philip C. Kannan
*Assistant Examiner*—Jerry Redman
*Attorney, Agent, or Firm*—Jacox & Meckstroth

[57] ABSTRACT

An elongated extruded door sill member is supported by a wood base and includes a sloping top wall and a rear wall connected by integral channel portions and a thermal barrier. The channel portions and barrier cooperate to define an upwardly facing cavity, and strips of resilient closed cell foam material are mounted within the channel portions. A vertically adjustable rail member extends longitudinally within the cavity and has side flanges projecting downwardly into the foam strips to form fluid-tight continuous seals. Opposite end portions of the rail member carry pads of the resilient foam material between the flanges for engaging the strips, the channel portions and the thermal barrier to form fluid-tight seals at the ends of the rail member.

10 Claims, 1 Drawing Sheet

ADJUSTABLE THRESHOLD ASSEMBLY WITH WATER-TIGHT SEALS

BACKGROUND OF THE INVENTION

In the art of adjustable threshold assemblies, for example, of the general type disclosed in U.S. Pat. No. 3,762,100 and No. 3,967,412, a vertically adjustable horizontal rail member extends below the bottom edge of the movable door and is supported by a wooden base member which also supports an extruded aluminum sill member. An extruded vinyl sealing element is retained by the sill member and engages the front surface of the adjustable rail member to form a seal with the rail member to avoid the accumulation of dirt and the flow of water and air into and through the cavity under the rail member. It is also known to construct the sill member in two sections and to connect the sections with a thermal barrier of plastics material, for example, as disclosed in U.S. Pat. No. 3,346,994.

As indicated above, it is highly desirable to prevent water from seeping into the cavity below the rail member and then through or around the threshold assembly into the sub-flooring or the adjacent floor covering, especially after vertical adjustment of the rail member. It is also desirable to obtain a dependable water-tight seal between opposite ends of the threshold assembly and the adjacent door jambs so that water does not flow around the ends of the sill and rail members and back into the cavity under the rail member and/or into the sub-flooring or floor covering.

SUMMARY OF THE INVENTION

The present invention is directed to an improved adjustable threshold assembly which incorporates a simplified and economical means for forming a positive and dependable fluid-tight seal between the adjustable rail member and the sill member, independent of the adjusted position of the rail member within its normal range of adjustment. The threshold assembly of the invention is especially desirable in that it prevents water from seeping around the rail member and back into the cavity below the rail member so that water does not seep into the subflooring or under the adjacent carpet or other floor covering.

In accordance with one embodiment of the invention, a threshold assembly includes a wood base member which supports an extruded aluminum sill member. The sill member has a rear wall member and opposing channel portions which are connected by a rigid thermal barrier and define a cavity receiving a vertically adjustable rail member. The channel portions support strips of closed cell resilient foam material which receive downwardly projecting side flanges of the rail member. A pair of pads of closed cell resilient foam material are carried by opposite end portions of the rail member between the downwardly projecting side flanges, and the pads engage the foam strips, the channel portions and the thermal barrier to form positive and dependable fluid-tight seals between the end portions of the rail member and the sill member. The strips and pads of resilient foam material compress and expand in response to vertical adjustment of the rail member and maintain the fluid-tight seals along the length of and at the ends of the rail member with each selected vertical position of the rail member.

Other features and advantages of the invention will be apparent from the following description, the accompanying drawing and the appended claims.

DESCRIPTION OF THE PREFERRED EMBODIMENT

Figure 1:
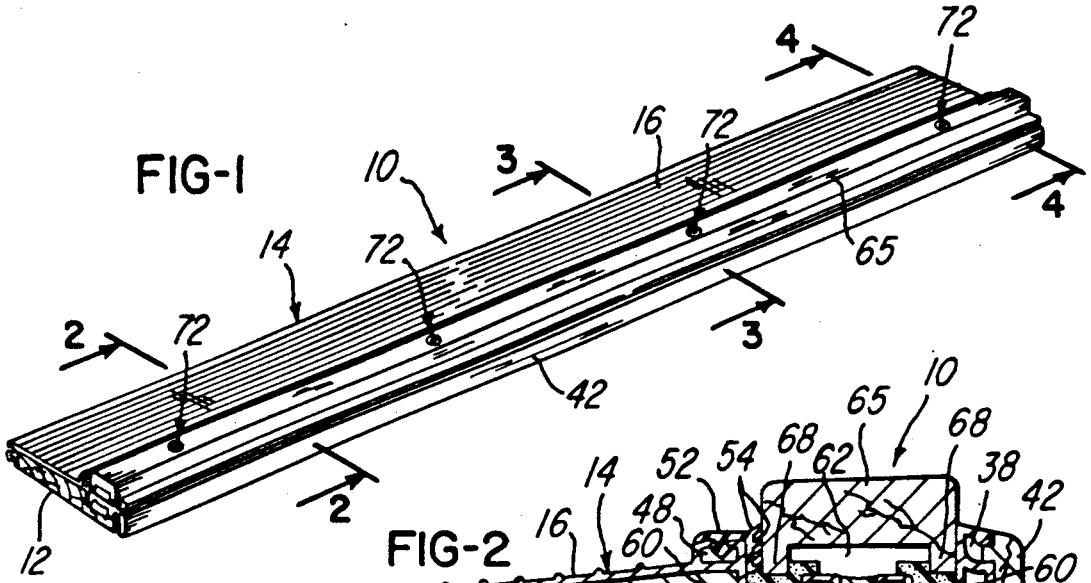
FIG. 1 is a perspective view of an adjustable threshold assembly constructed in accordance with the invention.
Figure 2:
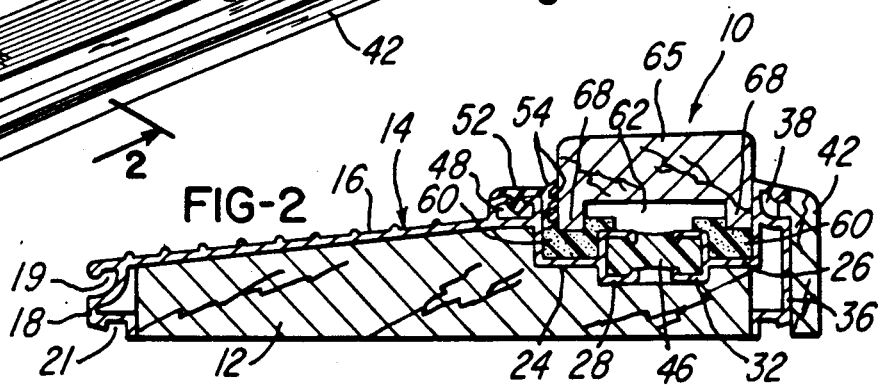
FIG. 2 is a section of the assembly, taken generally on the line 2—2 of FIG. 1.

FIG. 1 illustrates a threshold assembly 10 which is adapted to be mounted on sub-flooring below a swinging or sliding door and includes an elongated base member 12 which is preferably formed of wood such as spruce. The base member 12 is covered by an elongated sill member 14 which is preferably extruded of aluminum and includes a sloping top wall 16 and a front wall 18 defining hook-like recesses 19 and 21 which form an interlock with an extended sill extension member (not shown). The sill member 14 also includes a set of downwardly projecting channel portions 24 and 26 which include a pair of opposing channel portions 28 and 32 each having a C-shaped cross sectional configuration. The channel portion 26 connects with a hollow rear wall 36 having an upper hook-like recess 38 for receiving a projection of a longitudinally extending trim member 42 preferably constructed of wood such as oak. The recess 38 is also used to form an interlock with an extruded sill extension member (not shown).

The channel portions 28 and 32 of the sill member 14 are rigidly connected by a thermal barrier 46 preferably formed of a rigid plastics material such as a rigid polyurethane. When the sill member 14 is extruded, the bottom horizontal legs or walls of the channel portions 28 and 32 are integrally connected by an aluminum wall (not shown) which is removed or machined away after the connected channel portions 28 and 32 are filled with the rigid polyurethane material forming the thermal barrier 46. The sloping top wall 16 of the sill member 14 also defines a longitudinally extending undercut groove 48 which receives an arrow-shaped portion of a longitudinally extending semi-rigid sealing element 52 having a series of vertically spaced flexible fins 54. Preferably, the sealing element 52 is formed as a dual durometer vinyl extrusion with the fins 54 being substantially more flexible than the remaining portion of the sealing element.

In accordance with the present invention, a pair of sealing members or strips 60 are each constructed of a resilient closed cell foam material such as a resilient polyvinyl foam. The strips 60 extend within the channel portions 24 and 26 and are adhesively attached to the channel portions which cooperate with the channel portions 28 and 32 and the barrier 46 to define an upwardly facing and longitudinally extending cavity 62. An adjustable rail member 65 extends the full length of the sill member 14 and is preferably constructed of a hard wood such as oak. The rail member 65 includes a pair of longitudinally extending side ribs or flanges 68 which project downwardly into the corresponding strips 60 of resilient foam material. The rear surface of the rail member 65 engages the rear wall 36 of the sill member 14, and the flexible fins 54 of the sealing member 52 engage the forward face of the rail member 65.

Figure 3:
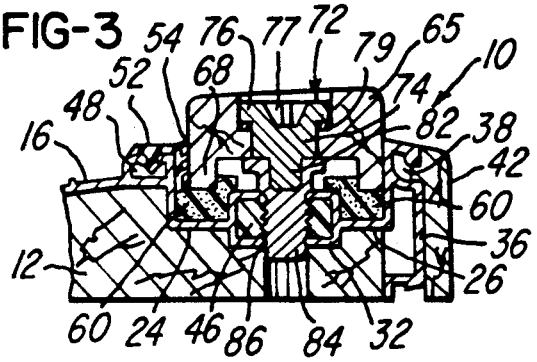
FIGS. 3 and 4 are fragmentary sections of the threshold assembly, taken generally on the lines 3—3 and 4—4 of FIG. 1, respectively.

Referring to FIGS. 1 and 3, the rail member 65 is vertically adjustable within the cavity 62 by means of a set of longitudinally spaced screw elements or assemblies 72 which are carried by the rail member 65. Each of the screw assemblies 72 includes an upper portion or section 74 having a top cylindrical head 76 defining a Phillips-type recess 77. The head 76 defines a shoulder which engages a sealing washer 79, preferably constructed of a polyvinyl material. The upper section 74 of each screw assembly 72 also has a bottom stud 82 which is formed with straight knurls and is press-fitted into a bore formed within an externally threaded lower section 84 having a top flange 86 engaging the rail member 65. After the upper section 74 of each screw assembly 72 is inserted into its corresponding hole within the rail member 65, the lower section 84 is pressed onto the stud 82 so that each screw assembly is captive or retained by the rail member 65 but is rotatable relative to the rail member 65.

As shown in FIG. 3, the opposing channel portions 28 and 32 are provided with a tapped hole 86 for each of the screw assemblies 72. When the rail member 65 is adjusted vertically by rotation of the screw assemblies 72, the resilient foam strips 60 compress and expand so that they always remain in continuous contact with the bottom edge portions of the flanges 68 of the rail member 65 and thereby maintain a positive water and air or fluid-tight seal between the rail member and the sill member 14 along the full length of the rail and sill member.

Figure 4:
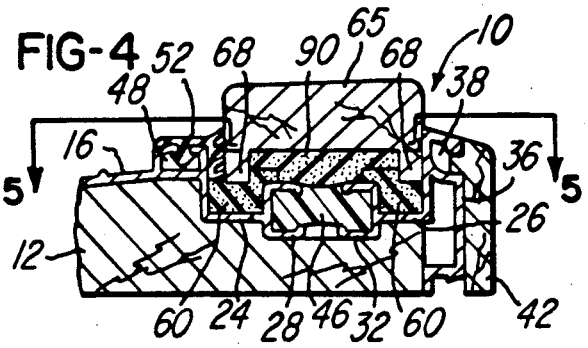
Figure 5:
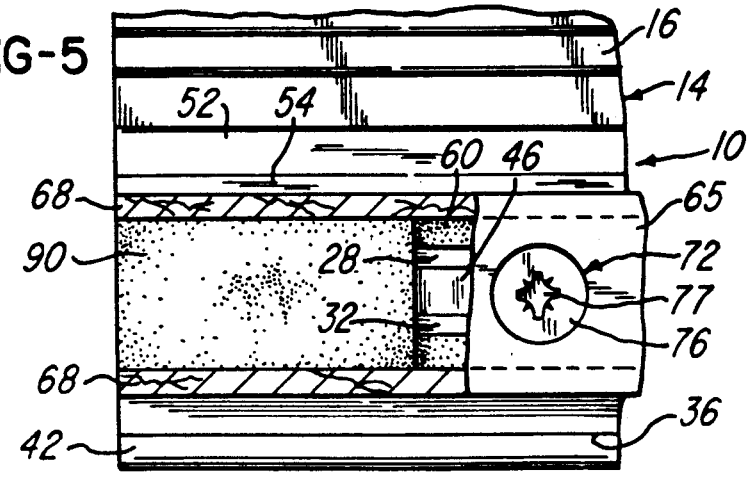
FIG. 5 is a fragmentary plan view and part section of an end portion of the threshold assembly as taken generally on the line 5—5 of FIG. 4.

Referring to FIGS. 4 and 5, a pair of resilient pads 90 are preferably formed of a closed cell polyvinyl foam material and are carried by or mounted on opposite end portions of the rail member 65 within the recess defined between the side flanges 68 of the rail member. The pads 90 are cemented to the underneath surface of the rail member 65, and the pads engage the foam strips 60, the channel portions 28 and 32 and the thermal barrier 46 to form a water and air or fluid-tight seal between each end portion of the rail member 65 and the sill member 14.

From the drawing and the above description, it is apparent that a threshold assembly constructed in accordance with the present invention, provides desirable features and advantages. As mentioned above, the resilient closed cell foam strips 60 provide for a positive and dependent fluid-tight seal between the adjustable rail member 65 and the sill member 14 for the entire length of the sill member and for an extended period of use regardless of the adjusted vertical position of the rail member. In addition, the resilient closed cell foam pads 90 provide for a positive and dependable fluid-tight seal between opposite end portions of the rail member 65 and the underlying portions of the sill member 14. Thus the threshold assembly of the invention assures that no water or air will flow under the rail member 65 and into the cavity 62. As a result, water is prevented from seeping into the sub-flooring supporting the threshold assembly or under the adjacent floor covering extending from the rear wall 36 and trim strip 42 of the threshold assembly.

While the form of threshold assembly herein described constitutes a preferred embodiment of the invention, it is to be understood that the invention is not limited to this precise form, and that changes may be made therein without departing from the scope and spirit of the invention as defined in the appended claims.

The invention having thus been described, the following is claimed:

1. An improved threshold assembly adapted to be installed below the bottom surface of a movable door, comprising an elongated horizontal sill member including a sloping top wall connected to walls defining a longitudinally extending and upwardly facing cavity, a first resilient closed cell foam material within said cavity, an elongated rail member disposed within said cavity and having opposite end portions and a bottom surface, said rail member including longitudinally extending means projecting downwardly into said first foam material within said cavity to form a fluid-tight dependable seal between said rail member and said sill member, means for adjusting said rail member vertically within said cavity, a pad of second resilient closed cell foam material engaging said bottom surface of each said end portion of said rail member, each said pad of second foam material overlapping and engaging said first foam material within said cavity to form fluid-tight seals at said opposite end portions of said rail member, and said first and second foam material being compressible and expandable in response to vertical adjustment of said rail member for maintaining said fluid-tight seal with different vertical positions of said rail member.

2. A threshold assembly as defined in claim 1 wherein said downwardly projecting means on said rail member include side flanges, said walls defining said cavity include a first channel portion and a second channel portion, and separate strips of said foam material within said channel portions for receiving the corresponding said flanges of said rail member.

3. A threshold assembly as defined in claim 2 wherein said first and second channel portions are parallel spaced, and a rigid plastics material extending between said strips and connecting said channel portions to form a thermal barrier therebetween.

4. A threshold assembly as defined in claim 2 wherein said means for adjusting said rail member comprise a plurality of longitudinally spaced and rotatable vertical screw elements, and said screw elements threadably engage said first and second channel portions between said strips of foam material.

5. An improved threshold assembly adapted to be installed below the bottom surface of a movable door, comprising an elongated horizontal sill member including a sloping top wall connected to a downwardly projecting first channel portion, an elongated rear wall member connected to a downwardly projecting second channel portion, means connecting said first and second channel portions and cooperating with said channel portions to define a longitudinally extending cavity, a first resilient closed cell foam material extending longitudinally within each said channel portion, an elongated rail member disposed within said cavity and having opposite end portions and a bottom surface, said rail member including longitudinally extending and parallel spaced flanges projecting downwardly into said first foam material to form a fluid-tight dependable seal between said rail member and each said channel portion, means for adjusting said rail member vertically within said cavity, a pad of second resilient closed cell foam material engaging said bottom surface of each said end portion of said rail member, each said pad of second foam material overlapping and engaging said first foam material within said cavity to form fluid-tight seals at said opposite end portions of said rail member, and said first and second foam material being compressible and expandable in response to vertical adjustment of said rail member for maintaining said fluid-tight seal with different vertical positions of said rail member.

6. A threshold assembly as defined in claim 5 wherein said first and second channel portions are parallel spaced, and a rigid plastics material extending between said strips and connecting said channel portions to form a thermal barrier therebetween.

7. A threshold assembly as defined in claim 5 wherein said means for adjusting said rail member comprise a plurality of longitudinally spaced and rotatable vertical screw elements, and said screw elements threadably engage said first and second channel portions between said foam material engaging said flanges.

8. An improved threshold assembly adapted to be installed below the bottom surface of a movable door, comprising an elongated base member, a horizontal sill member mounted on said base member and including a sloping top wall connected to a downwardly projecting first channel portion, and elongated rear wall member connected to a downwardly projecting second channel portion, means connecting said first and second channel portions and cooperating with said channel portions to define a longitudinally extending cavity, a first resilient closed cell foam material extending longitudinally within said channel portions, an elongated rail member disposed within said cavity and having opposite end portions and a bottom surface, said rail member including longitudinally extending and parallel spaced flanges projecting downwardly into said first foam material to form fluid-tight dependable seals between said rail member and said channel portions, screw means for adjusting said rail member vertically within said cavity, a pad of second resilient closed cell foam material disposed between said bottom surface of each said end portion of said rail member and said first foam material within said channel portions to form fluid-tight seals at said opposite end portions of said rail member and across the entire width of said rail member, and said first and second foam material being compressible and expandable in response to vertical adjustment of said rail member for maintaining said fluid-tight seals with different vertical positions of said rail member.

9. An improved threshold assembly adapted to be installed below the bottom surface of a movable door, comprising an elongated horizontal sill member including a sloping top wall connected to longitudinally extending walls defining an upwardly facing cavity, an elongated rail member disposed within said cavity and having opposite end portions and a bottom surface, means forming a continuous fluid-tight seal along the length of said rail member, means for adjusting said rail member vertically within said cavity, a set of pads of resilient closed cell foam material disposed between said bottom surface of said end portions of said rail member and said walls defining said cavity, said pads of foam material extending across the entire width of said cavity at said end portions to form fluid-tight seals at said opposite end portions of said rail member across the entire width of said rail member, and said foam material being compressible and expandable in response to vertical adjustment of said rail member for maintaining said fluid-tight seals with different vertical positions of said rail member.

10. A threshold assembly as defined in claim 9 wherein said rail member has longitudinally extending and downwardly projecting side flanges, and a pair of said pads of said foam material disposed between said side flanges adjacent said opposite end portions of said rail member.

* * * * *